US011629436B2

(12) United States Patent
Fan et al.

(10) Patent No.: US 11,629,436 B2
(45) Date of Patent: Apr. 18, 2023

(54) LIGHT WEIGHT HEAT-PRESERVING FIBER AND PREPARATION METHOD THEREOF

(71) Applicant: JIANGSU HENGLI CHEMICAL FIBRE CO., LTD., Wujiang (CN)

(72) Inventors: Hongwei Fan, Wujiang (CN); Shanshui Wang, Wujiang (CN); Lixin Yin, Wujiang (CN); Lili Wang, Wujiang (CN)

(73) Assignee: JIANGSU HENGLI CHEMICAL FIBRE CO., LTD., Wujiang (CN)

( * ) Notice: Subject to any disclaimer, the term of this patent is extended or adjusted under 35 U.S.C. 154(b) by 373 days.

(21) Appl. No.: 16/638,479

(22) PCT Filed: Jul. 27, 2018

(86) PCT No.: PCT/CN2018/097506
§ 371 (c)(1),
(2) Date: Feb. 12, 2020

(87) PCT Pub. No.: WO2019/114281
PCT Pub. Date: Jun. 20, 2019

(65) Prior Publication Data

US 2020/0263326 A1 Aug. 20, 2020

(30) Foreign Application Priority Data

Dec. 14, 2017 (CN) ..... 201711341957.2

(51) Int. Cl.
*D01D 5/24* (2006.01)
*D01D 5/096* (2006.01)
(Continued)

(52) U.S. Cl.
CPC ..... *D01D 5/096* (2013.01); *D01D 5/088* (2013.01); *D01D 5/12* (2013.01); *D01D 5/24* (2013.01);
(Continued)

(58) Field of Classification Search
CPC ..... D01D 5/24; D01D 5/096
See application file for complete search history.

(56) References Cited

U.S. PATENT DOCUMENTS

2017/0304128 A1* 10/2017 Lennon ..... D01F 8/06

FOREIGN PATENT DOCUMENTS

CN 202610409 U 12/2012
CN 104562240 A 4/2015
(Continued)

OTHER PUBLICATIONS

Translation by the International Search Authority of CN 206232900 U (Year: 2017).*
(Continued)

*Primary Examiner* — Timothy Kennedy
*Assistant Examiner* — Alexander A Wang
(74) *Attorney, Agent, or Firm* — Bayramoglu Law Offices LLC

(57) ABSTRACT

A lightweight heat-preserving fiber and a preparation method thereof are provided, wherein the fiber is prepared by measuring, composite spinneret's extruding, cooling, oiling, drawing, heat setting and winding a polyester melt. The composite spinneret has a hollow spinning hole and a circular spinning hole. The ratio of the micropore length of hollow spinning hole to circular spinning hole equals to the ratio of the equivalent diameter of hollow spinning hole to circular spinning hole multiplies the coefficient K, and the equivalent diameter is the ratio of the cross-sectional area to the circumference of the cross-section, the coefficient K ranges from 0.97 to 1.03. The oil agent contains a crown ether, and the content of the crown ether ranges from 67.30 to 85.58 wt %. The thermal conductivity of a knitted fabric having a basis weight of 100 g/m$^2$ prepared by lightweight heat-preserving fiber is no larger than 0.150 W/m·K.

13 Claims, 1 Drawing Sheet

(51) Int. Cl.

| | |
|---|---|
| ***D01F 6/62*** | (2006.01) |
| ***D01F 11/08*** | (2006.01) |
| ***D06M 13/11*** | (2006.01) |
| ***D06M 13/224*** | (2006.01) |
| ***D06M 13/256*** | (2006.01) |
| ***D06M 13/295*** | (2006.01) |
| ***D01D 5/12*** | (2006.01) |
| ***D01D 5/088*** | (2006.01) |
| ***D01D 10/02*** | (2006.01) |
| ***D01D 7/00*** | (2006.01) |
| *D06M 101/32* | (2006.01) |

(52) U.S. Cl.

CPC ..... *D01D 7/00* (2013.01); *D01D 10/02* (2013.01); *D01F 6/62* (2013.01); *D01F 11/08* (2013.01); *D06M 13/11* (2013.01); *D06M 13/224* (2013.01); *D06M 13/256* (2013.01); *D06M 13/295* (2013.01); *D06M 2101/32* (2013.01)

(56) References Cited

FOREIGN PATENT DOCUMENTS

| | | | | |
|---|---|---|---|---|
| CN | 106400163 | A | | 2/2017 |
| CN | 206232900 | U | * | 6/2017 |
| CN | 206232900 | U | | 6/2017 |
| CN | 107988640 | A | | 5/2018 |
| EP | 1885920 | A1 | | 2/2008 |
| JP | 2007197887 | | * | 8/2007 |
| JP | 2010203000 | | * | 9/2010 |
| KR | 20150083473 | A | | 7/2015 |

OTHER PUBLICATIONS

JP2010203000 machine translation (Year: 2010).*
JP2007197887 machine translation (Year: 2007).*

* cited by examiner

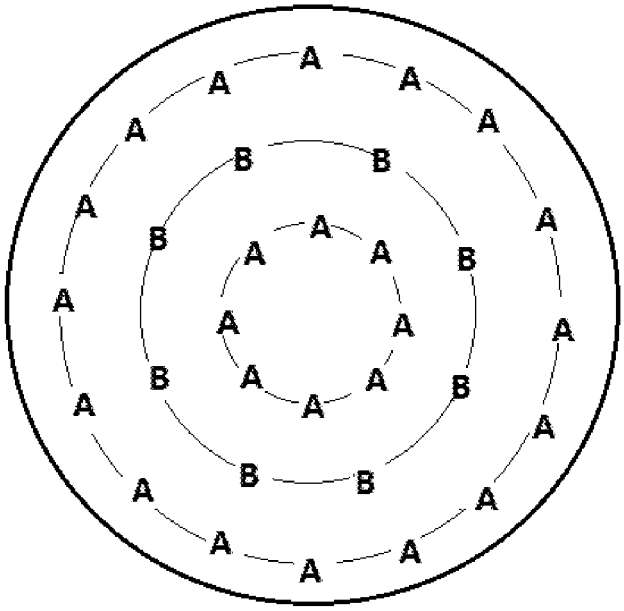
A
A
A
A
A
A
A
A
A
A
A
A
A
A
A
A
A
A
A
A
A
A
A
A
B
B
B
B
B
B
B
B
B
B
B
B

LIGHT WEIGHT HEAT-PRESERVING FIBER AND PREPARATION METHOD THEREOF

CROSS REFERENCE TO THE RELATED APPLICATIONS

This application is the national phase entry of International Application No. PCT/CN2018/097506, filed on Jul. 27, 2018, which is based upon and claims priority to Chinese Patent Application No. 201711341957.2, filed on Dec. 14, 2017, the entire contents of which are incorporated herein by reference.

TECHNICAL FIELD

This invention belongs to the technical field of fiber production, and more particularly, relates to a lightweight heat-preserving fiber and its preparation method.

Background

Since the invention of polyethylene terephthalate (PET) fiber, it has been rapidly developed due to its excellent performance, and its output has become the world's finest synthetic fiber. PET fiber has a series of excellent properties such as high breaking strength, high modulus of elasticity, moderate resilience, excellent heat setting performance, good heat and light resistance, and good resistance to acid, alkali and corrosion, and the fabric prepared therefrom has wrinkle resistance and It has been widely used in the fields of fiber, bottle packaging, film and sheet, and its output has increased year by year, and its industry status has been significantly improved. However, the existing PET fiber generally only meets the requirements of one aspect of lightweight warming and moisture wicking performance, while PET fiber which satisfies the functions of lightweight warming and moisture wicking is rarely studied, and the technology is immature, so preparation at the same time, PET fibers with lightweight thermal and moisture wicking properties are extremely valuable.

The cross-sectional shape of the fiber affects the properties of the yarn and the fabric. Different cross-sectional shapes and sizes of the spinneret can be used to spun the shaped fibers of different cross-sectional shapes. The material and shape characteristics of the fibers affect the properties of the fibers, fibers and the arrangement of the fibers in the yarn affects the properties of the yarn. The arrangement of the yarns and yarns in the fabric affects the properties of the fabric, and thus the shape characteristics of the fibers are essential to the properties of the yarn and fabric. Shaped fibers are chemical fibers with a special cross-sectional shape and function that are spun from a certain geometry of the spinning hole. At present, a wide variety of shaped fibers have been developed, which can be roughly classified into a triangular shape, a polygonal shape, a flat shape, a hollow shape, and a diamond shape according to the cross-sectional shape thereof. However, the profiled fiber has a single cross-sectional shape and its function is relatively simple. Only by the profile of the fiber cross-section cannot solve the problem that the polyester fiber cannot have both lightweight and moisture wicking performance, such as the cross-sectional shape of the shaped fiber. Diversification will hopefully solve the problem that polyester fiber cannot combine lightweight and moisture wicking performance.

In recent years, the same-board double-shaped fiber or the same-plate multi-shaped fiber is an important means to solve the shortage of the existing shaped fiber, which can combine the advantages of two or more shaped fibers to meet the high quality and function of the shaped fiber textile. Diversified needs. Although there are literatures and patents on the same board double-shaped fibers or multi-double shaped fibers in the same board, but the fiber is difficult in actual production. Since the polyester melt is a non-Newtonian fluid, it is a viscoelastic fluid. When it is viscous flowing in the spinning hole, it will elastically deform and form a certain pressure. Therefore, the polyester melt will come out after the spinning hole. A certain pressure drop occurs, and the shape, size, length and relationship of the spinning holes have a great influence on the pressure drop. The existing research generally only considers the shape of the spinning hole or the cross-sectional area. Equal, but the influence of shape, size and length on each other is not involved, which will cause the pressure drop of the polyester melt to flow out from the differently shaped spinning holes of the same spinneret, resulting in different cross-section fibers. There is a difference in the extrusion speed between the two, which affects the smooth progress of the fiber spinning process.

Therefore, how to overcome the shortcomings of the prior art that the double-shaped fiber of the same plate or the multi-shaped fiber of the same plate is difficult to spin, and the preparation of a fiber containing a plurality of cross-sectional shapes simultaneously has the advantages of lightweight heat retention and moisture wicking performance are the problems to be solved.

SUMMARY

An object of the present invention is to overcome the above problems in the prior art and to provide a lightweight thermal insulation fiber capable of simultaneously having good lightweight warming and moisture wicking performance and a preparation method thereof. The invention adopts the combination of the circular ultrafine fiber and the hollow fiber, and the ultrafine fiber easily enters the void in the fabric, so that the gap between the yarns becomes smaller, thereby reducing the convection heat dissipation between the yarns, thereby making the fabric warm. The effect is good and the wind blocking ability is strong. At the same time, the capillary effect of the fiber is improved, and the shortcoming of the warm fabric of the hollow fiber due to the increase of humidity is overcome, so that the fiber of the invention has both lightweight retention and moisture wicking. Features; the use of crown-containing ether oil agent improves the heat resistance and lubricity of the oil agent and improves the quality of the fiber.

In order to achieve the above object, the technical solution adopted by the present invention is:

A lightweight heat-preserving, a bundle of lightweight thermal insulation fibers extruded from the same spinneret contains both hollow monofilament and round monofilament, and the lightweight heat-preserving is made of polyester, which is prepared from lightweight heat-preserving. The thermal conductivity of a knitted fabric having a basis weight of 100 g/m$^2$ is no larger than 0.150 W/m·K.

As a preferred technical solution:

In a lightweight thermal insulation fiber as described above, the hollow monofilament has a fineness of 1.5 to 2.5 dtex, and the circular monofilament has a fineness of 0.20 to 0.30 dtex.

A lightweight thermal insulation fiber as described above, wherein the lightweight heat-preserving has a fineness of 75 to 100 dtex, a breaking strength of no smaller than 2.1 cN/dtex, an elongation at break of 20.0±2.0%, and a crimp shrinkage ratio of no larger than 9.0%. The density deviation rate is no larger than 2.0%, the breaking strength CV value is no larger than 7.0%, the breaking elongation CV value is no larger than 8.0%, the crimping shrinkage coefficient of variation coefficient CV value is no larger than 8.5%, and the boiling water shrinkage rate is 3.5±0.5%.

The lightweight thermal insulation fiber as described above, the capillary parameter of the lightweight thermal insulation fiber is no smaller than 0.10, and the capillary parameter of the conventional product is 0.03 to 0.04, and the capillary parameter of the fiber produced by the invention is obviously improved due to the conventional product, so The moisture wicking function of the fiber and the thermal resistance of the fabric no smaller than 0.18 $m^2 \cdot {}^\circ C./W$ can provide good warmth retention.

The invention also provides a method for preparing a lightweight heat-preserving as described above, which is light-weighted by metering, multi-spinning, cooling, oiling, drawing, heat setting and winding of a polyester melt. Warm fiber The composite spinneret plate is provided with a hollow spinning hole and a circular spinning hole at the same time, and the ratio of the micropore length of the hollow spinning hole to the circular spinning hole is equal to the hollow spinning hole and the circular spray The ratio of the ratio of the equivalent diameter of the wire hole to the coefficient K, which is the ratio of the cross-sectional area of the spinneret hole to the circumference of the cross-section, and the coefficient K ranges from 0.97 to 1.03;

The oil agent for oiling contains crown ether, and the content of crown ether is 67.30-85.58 wt %. The content of crown ether in the oil agent of the invention needs to be kept within a certain range, and the amount of crown ether added is too low to be An oil agent having low viscosity, good heat resistance and high oil film strength is obtained, and if the crown ether is added in too much, other performance indexes of the oil agent are affected.

The invention obtains an oil agent with low viscosity, good heat resistance and high oil film strength by introducing crown ether into an oil agent. The crown ether is a heterocyclic organic compound containing a plurality of ether groups and a crown ether. The wetting ability of the surfactant is larger than that of the corresponding open-chain compound, the crown ether has better solubilization, and the solubility of the salt compound in the organic compound is lower, but the addition of the crown ether makes the salt compound in the organic matter. The solubility is improved. The higher viscosity of the oil agent in the prior art is mainly due to the fact that the oil agent contains ordinary polyester compounds or polyether compounds. Due to the large molecular weight and hydrogen bonding, the intermolecular effect of the compounds is manifested as kinematic viscosity. Larger, thus resulting in higher viscosity of the oil agent, the viscosity of the oil agent can be significantly reduced after the addition of the crown ether, mainly because the crown ether itself has a low viscosity and is a beaded small molecule, the crown ether is better compatible with the polyether. In the ester compound or polyether oil system, the molecular chain between the polyester compound or the polyether compound is simultaneously inserted to shield the interaction between the molecular chains, thereby reducing the viscosity of the oil system. The lower oil film strength of the oil agent in the prior art is mainly due to the fact that the antistatic agent of the chemical fiber oil agent mostly contains metal ions or exists in the form of a salt, which results in compatibility of the antistatic agent with the polyester compound or polyether in the oil agent. The poorness of the crown ether can increase the strength of the oil film mainly due to the salt-solubility effect of the crown ether, the compatibility of the antistatic agent with the polyester compound or the polyether, and the strength of the oil film. In addition, the crown ether has a higher volatilization point and excellent heat resistance stability, and the heat resistance of the oil agent after the introduction of the crown ether is also remarkably improved.

As a preferred technical solution:

In the method as described above, the microporous length of the hollow spinning hole or the circular spinning hole is 0.20 to 1.28 mm, and the equivalent diameter of the hollow spinning hole or the circular spinning hole is 0.10 to 0.32 mm;

All the spinning holes are arranged concentrically on the spinneret, and the center of all the spinning holes or the center of the circumscribed circle is located on a concentric circle, the concentric circles are equally spaced concentric circles, and the spacing of the spinning holes on the same ring is equally spaced arrangement.

In the method described above, the spinning holes on the same ring are hollow-shaped spinning holes or circular spinning holes, and the shapes of the spinning holes on the adjacent two rings are different;

Or, the same ring contains both a hollow spinning hole and a circular spinning hole, the number of hollow spinning holes and the circular spinning holes on the same ring or the circular spinning holes and the hollow spinning holes the number ratio is 5-8:1.

As described above, the oil agent has a thermal weight loss of less than 15% by weight after heat treatment at 200° C. for 2 hours, the crown ether has a higher volatile point and excellent heat stability, and the heat resistance of the oil after the introduction of the crown ether also achieved significant improvements;

The oil agent has a kinematic viscosity of 27.5 to 30.1 $mm^2/s$ at (50±0.01) ° C., and the kinematic viscosity of the oil agent after being formulated into a concentration of 10 wt % is 0.93 to 0.95 $mm^2/s$, crown ether. The ability to reduce the viscosity of the oil is mainly due to the lower viscosity of the crown ether itself and the beaded small molecule. After the introduction of the crown ether in the oil system, the crown ether is better compatible with the polyester compound or the polyether compound. In the oil system, simultaneously entering the molecular chain of the polyester compound or the polyether compound, shielding the force between the molecular chains, thereby reducing the viscosity of the oil system;

The oil film strength of the oil agent is 121-127N. In the prior art, the oil film strength of the oil agent is relatively low, generally about 110N, which is mainly because the antistatic agent of the chemical fiber oil agent mostly contains metal ions or exists in the form of salt. The compatibility between the antistatic agent and the polyester compound or the polyether compound in the oil agent is poor, and the crown ether can improve the oil film strength mainly due to the salt dissolution effect after the addition of the crown ether, and the antistatic agent and the polyester compound are improved. The compatibility of the compound or polyether, thereby increasing the strength of the oil film;

The surface tension of the oil agent is 23.2-26.8 cN/cm, and the specific resistance is $1.0\times10^8$-$1.8\times10^8 \Omega\cdot cm$;

After oiling, the static friction coefficient between fiber and fiber is 0.250-0.263, and the dynamic friction coefficient is 0.262-0.273;

After oiling, the coefficient of static friction between fiber and metal is 0.202-0.210, and the coefficient of dynamic friction is 0.320-0.332.

The crown ether is 2-hydroxymethyl-12-crown-4,15-crown-5 or 2-hydroxymethyl-15-crown-5;

The oil agent further comprises mineral oil, potassium phosphate salt, trimethylolpropane laurate and sodium alkyl sulfonate;

The mineral oil is one of mineral oils of 9 #-17 #;

The potassium phosphate salt is a potassium salt of lauryl phosphate, an isomeric tridecyl polyoxyethylene ether phosphate potassium salt or a tetradecyl alcohol phosphate potassium salt;

The sodium alkyl sulfonate is sodium dodecyl sulfate, sodium pentadecyl sulfonate or sodium hexadecane sulfonate;

When the oil agent is used, the water is disposed in an emulsion having a concentration of 10-20% by weight;

The oil preparation method is as follows: the crown ether is mixed with the potassium phosphate salt, the trimethylolpropane laurate and the sodium alkylsulfonate, and then added to the mineral oil to be uniformly stirred to obtain an oil agent; the amount of each component added is as follows:

Mineral oil 0-10 parts;

Trimethylolpropane laurate 0-20 parts;

Crown ether 70-100 parts;

Phosphate potassium salt 8-15 parts;

Sodium alkyl sulfonate 2-7 parts;

The mixing is carried out at a normal temperature, and the stirring temperature is 40 to 55° C., and the time is 1 to 3 hours.

As described above, the spinning process parameters of the lightweight heat-preserving fiber polyester pre-oriented yarn (POY) are as follows:

Spinning temperature: 280-290° C.;

Cooling temperature: 20-25° C.;

Winding speed: 2800-3200 m/min;

The spinning process parameters of the lightweight heat-preserving fiber draw texturing yarn (DTY) are as follows:

Spinning speed: 550-750 m/min;

Styling overfeed rate: 3.5-5.5%;

Winding overfeed rate: 2.5-5.0%;

T1: 250-265° C.;

T2: 120-135° C.;

DR: 1.4-1.5;

D/Y: 1.5-1.6;

Network pressure: 0.05-0.3 MPa.

Invention mechanism:

The polyester melt is a non-Newtonian fluid, which is a viscoelastic fluid, which undergoes viscous flow in the spinning hole, and elastic deformation occurs, and the existence of elastic deformation is one of the key factors for spinning instability. The length of the micropore of the spinning hole and the circumference of the cross section and the cross-sectional area of the spinning hole have a great influence on the degree of storage and relaxation of the elastic energy in the melt. The present invention provides two sprays on the same spinneret. The micropore length, cross-sectional area and cross-sectional circumference of the wire hole establish a certain relationship between the sizes of the two kinds of spinning holes, thereby realizing the relaxation of the melt elastic energy, so that it passes through different spinning holes. The same pressure drop reduces the pressure drop and puffing of the melt at the outlet, thereby ensuring smooth and stable melt spinning.

When the melt passes through the spinning hole of the spinneret, the formula for calculating the melt pressure drop is as follows:

$$\Delta P = \frac{S_{inner}}{S_{cross\text{-}section}} \cdot \tau$$

Wherein, ΔP is the pressure drop of the melt, $S_{inner}$ is the inner wall area of the spinning hole, and its value is equal to the product of the length of the micropore of the spinning hole and the circumference of the cross section of the spinning hole, and $S_{cross\text{-}section}$ is the cross-sectional area of the spinning hole. τ is the viscous fluid shear stress of the material.

For polyester melts that have different shapes of spinneret holes A and spinneret holes B on the same spinneret, the speed at which the melt is extruded from different spinning holes is uniform or the difference is small, and it must be ensured that The pressure drop in the process of different spinning holes is the same or the difference is within a certain range, that is, ΔPA=KΔPB, wherein the coefficient K=0.97-1.03, therefore, the micropore length of different spinning holes and the cross section of the spinning hole can be derived. The relationship between the perimeter and the cross-sectional area of the spinneret, which is:

$$\frac{D_A}{D_B} = K\frac{S_A}{S_B} \times \frac{L_B}{L_A} = K\frac{B_A}{B_B}$$

Wherein D is the micropore length of the spinneret hole, S is the cross-sectional area of the spinneret hole, L is the perimeter of the cross section of the spinneret hole, and B is the equivalent diameter of the spinneret hole.

The present invention ensures the spinning by utilizing a composite spinneret having a plurality of special shapes of the spinning holes and having a certain relationship between the micropore length, the cross-sectional area and the cross-sectional circumference of the two spinning holes to ensure the smooth and stable spinning process. This can solve the problems of unevenness of fibers, unevenness of strength, uneven dyeing, etc. caused by inconsistent pressure drop during extrusion of different melts in the same process. Thus, it improves the stability of the product, and it realizes the simultaneous extrusion of hollow monofilaments and round monofilaments from the same spinneret. The combination of circular microfibers and hollow fibers, the ultrafine fibers easily enter the fabric gap, and the gap between the yarns becomes small, and thus the convective heat dissipation between the yarns is reduced, so that the fabric has a good warming effect and a strong wind-shielding ability, and at the same time, the capillary effect of the fiber is improved, and the thermal fabric of the hollow fiber is overcome due to the increase in humidity and the heat is uncomfortable. The disadvantage is that the fiber finally obtained by the invention has the characteristics of lightweight keeping warm and moisture wicking.

Beneficial effects:

(1) A lightweight heat-preserving fiber of the present invention has the advantages of hollow monofilament and circular monofilament, and has an ideal lightweight heat-preserving and moisture wicking performance, and has excellent promotion value;

(2) A method for preparing a lightweight heat-preserving according to the present invention, wherein the oil agent containing the crown ether used in the oiling process has low viscosity, good heat resistance, high oil film strength, good smoothing performance and strong antistatic property. It improves the stability of the spinning and the processing properties of the fiber;

(3) A method for preparing a lightweight heat-preserving of the present invention, by setting the micropore length, cross-sectional area and cross-sectional circumference and establishing a certain relationship between of two kinds of spinning holes on the same spinneret ensure that the pressure drop of the polyester melt in the process of passing through different spinning holes is basically the same, so that the extrusion speed of the melt from the spinning hole is basically the same, which ensures the smooth and stable spinning.

BRIEF DESCRIPTION OF THE DRAWINGS

FIGURE is a schematic view of the arrangement of the spinning holes of the composite spinneret in Example 1 of the present invention.

DETAILED DESCRIPTION OF THE EMBODIMENTS

Hereinafter, the present invention will be described in more detail by the following examples. It should be noticed that these examples are only for illustrating the present invention and are not intended to limit the scope of the present invention. In addition, it should be noticed that after reading the content of the present invention, those skilled in this field can make various modifications or changes to the present invention, and these equivalent forms also apply to the scope of the appended claims of this application.

Example 1

A lightweight heat-preserving fiber, its preparation method comprises:

(1) the preparation of oil agent in oiling;

Uniformly mix 2-hydroxymethyl-12-crown-4 with dodecyl phosphate potassium salt, trimethylolpropane laurate and sodium hexadecane sulfonate at room temperature and put into 12 # mineral oil. Then uniformly stir at 40° C. for 2.5 hours to obtain an oil agent. By weight, the components are added with the following amounts: 12 # mineral oil 5 parts; 2-hydroxymethyl-12-crown-4 95 parts; dodecyl phosphate potassium salt 9 parts; sodium hexadecyl sulfonate 2 parts. The content of crown ether in the prepared oil agent is 85.58 wt %, and the oil agent has excellent high temperature resistance. After heat treatment at 200° C. for 2 hours, the weight loss of oil agent is 9 wt %, and the viscosity of the oil agent is relatively low, at (50±0.01) ° C. the kinematic viscosity is 29.5 $mm^2/s$, the kinematic viscosity with 10 wt % concentration after being dissolved by water is 0.93 $mm^2/s$, the oil film strength of the oil is 121 N, and the surface tension of the oil is 24.3 cN/cm. The specific resistance is $1.0\times10^8\Omega\cdot cm$. After oiling, the coefficient of static friction ($\mu_s$) between fiber and fiber (F/F) is 0.260, and the coefficient of dynamic friction ($\mu_d$) is 0.263. After oiling, fiber and metal (F/M) The coefficient of static friction ($\mu_s$) is 0.202, the coefficient of dynamic friction ($\mu_d$) is 0.330, and the oil agent is prepared by adding water to obtain an emulsion having a concentration of 19% by weight;

(2) The lightweight heat-preserving fiber obtained by subjecting the polyester melt to measuring, extrusion by composite spinneret, cooling, oiling, drawing, heat setting and winding.

The composite spinneret plate has a hollow spinning hole and a circular spinning hole at the same time, and a schematic arrangement diagram of the spinning hole is shown in FIGURE, wherein A represents a hollow spinning hole, and B represents a circular spinning hole. The ratio of the micropore length of A to B is equal to the ratio of the equivalent diameter of A to B multiplies the coefficient K, and the equivalent diameter is the ratio of the cross-sectional area to the circumference of the cross-section, the coefficient K is 1.01, the micro-hole length of the hollow spinning hole is 0.38 mm, and the micro-hole length of the circular spinning hole is 0.38 mm. The equivalent diameter is 0.18 mm, and all the spinning holes are arranged concentrically on the spinneret. The centers of all the spinning holes or the center of the circumscribed circle are on the concentric circles. The concentric circles are equidistant concentric circles on the same circle. The spinning holes on the same circle are arranged at equal intervals, and the spinning holes on the same circle are hollow spinning holes or circular spinning holes, and the shapes of the spinning holes on the adjacent two circles are different. The spinning process parameters of the lightweight heat-preserving fiber POY yarn are as follows: the spinning temperature is 280° C.; the cooling temperature is 21° C.; the winding speed is 3200 m/min; the spinning process parameters of the lightweight heat-preserving fiber DTY yarn are as follows: the spinning speed is 600 m/min; setting overfeed rate is 4.5%; winding overfeed rate is 3.0%; T1 is 258° C.; T2 is 127° C.; DR is 1.4; D/Y is 1.6; network pressure is 0.25 MPa.

The final obtained spinneret can extrude a bundle of lightweight heat-preserving fiber containing both hollow monofilament and round monofilament having a capillary parameter of 0.10. The knit fabric having a basis weight of 100 $g/m^2$ prepared from lightweight heat-preserving fibers has a thermal conductivity of 0.148 W/m·K, the hollow monofilament has a fineness of 1.8 dtex, and the circular monofilament has a fineness of 0.30 dtex. The lightweight thermal fiber has a fineness of 100 dtex, a breaking strength of 2.2 cN/dtex, an elongation at break of 18.0%, a crimp shrinkage of 8.3%, a linear density deviation of 1.3%, and a breaking strength CV of 6.4%, the elongation at break CV value of 7.5%, the variation coefficient CV of the crimp shrinkage rate of 8.2%, and the boiling water shrinkage of 3.5%.

Example 2

A lightweight heat-preserving fiber, its preparation method comprises:

(1) the preparation of oil agent in oiling;

Uniformly mix 15-crown-5 and isomeric tridecyl ethoxylate phosphate potassium salt, trimethylolpropane laurate and sodium dodecyl sulfate at room temperature and put into 13 # mineral oil. Then uniformly stir at 52° C. for 2 hours to obtain an oil agent. By weight, the components are added with the following amounts: 13 # mineral oil 10 parts; trimethylolpropane laurate 5 parts; 15-crown-5 70 parts; isomeric tridecyl ethoxylate phosphate potassium salt 8 parts, sodium dodecyl sulfate 6 parts. The content of crown ether in the prepared oil agent is 70.70 wt %, and the oil agent has excellent high temperature resistance. After heat treatment at 200° C. for 2 hours, the weight loss of oil agent is 13.5 wt %, and the viscosity of the oil agent is relatively low, at (50±0.01) ° C. the kinematic viscosity is 28.6 $mm^2/s$, the kinematic viscosity with 10 wt % concentration after being dissolved by water is 0.95 $mm^2/s$, the oil film strength of the oil is 126 N, and the surface tension of the oil is 24.9 cN/cm. The specific resistance is $1.2\times10^8\Omega\cdot cm$. After oiling, the coefficient of static friction ($\mu_s$) between fiber and fiber (F/F) is 0.251, and the coefficient of dynamic friction ($\mu_d$) is 0.262. After oiling, fiber and metal (F/M) The coefficient of static friction ($\mu_s$) is 0.202, the coefficient of dynamic friction ($\mu_d$) is 0.332, and the oil agent is prepared by adding water to obtain an emulsion having a concentration of 11% by weight;

(2) The lightweight heat-preserving fiber obtained by subjecting the polyester melt to measuring, extrusion by composite spinneret, cooling, oiling, drawing, heat setting and winding.

The composite spinneret plate has a hollow spinning hole and a circular spinning hole at the same time. The ratio of the micropore length of hollow spinning hole to circular spinning hole equals to the ratio of the equivalent diameter of hollow spinning hole to circular spinning hole multiplies the coefficient K, and the equivalent diameter is the ratio of the cross-sectional area to the circumference of the cross-section, the coefficient K is 0.99, the micro-hole length of the hollow spinning hole is 0.59 mm, and the micro-hole length of the circular spinning hole is 0.59 mm. The equivalent diameter is 0.10 mm, and all the spinning holes are arranged concentrically on the spinneret. The centers of all the spinning holes or the center of the circumscribed circle are on the concentric circles. The concentric circles are equidistant concentric circles on the same circle. The spinning holes on the same circle are arranged at equal intervals, and there are hollow spinning holes and circular spinning holes on the same circle. The quantity ratio of hollow spinning holes to the circular spinning holes is 5:1. The spinning process parameters of the lightweight heat-preserving fiber POY yarn are as follows: the spinning temperature is 286° C.; the cooling temperature is 22° C.; the winding speed is 2800 m/min; the spinning process parameters of the lightweight heat-preserving fiber DTY yarn are as follows: the spinning speed is 700 m/min; setting overfeed rate is 4.0%; winding overfeed rate is 4.5%; T1 is 256° C.; T2 is 129° C.; DR is 1.5; D/Y is 1.6; network pressure is 0.3 MPa.

The final obtained spinneret can extrude a bundle of lightweight heat-preserving fiber containing both hollow monofilament and round monofilament having a capillary parameter of 0.18. The knit fabric having a basis weight of 100 $g/m^2$ prepared from lightweight heat-preserving fibers has a thermal conductivity of 0.147 W/m·K, the hollow monofilament has a fineness of 2.3 dtex, and the circular monofilament has a fineness of 0.28 dtex. The lightweight thermal fiber has a fineness of 75 dtex, a breaking strength of 3.0 cN/dtex, an elongation at break of 20.0%, a crimp shrinkage of 8.2%, a linear density deviation of 1.5%, and a breaking strength CV of 6.2%, the elongation at break CV value of 7.9%, the variation coefficient CV of the crimp shrinkage rate of 8.4%, and the boiling water shrinkage of 3.0%.

Example 3

A lightweight heat-preserving fiber, its preparation method comprises:

(1) the preparation of oil agent in oiling;

Uniformly mix 2-hydroxymethyl-15-crown-5 and dodecacanol phosphate potassium salt, trimethylolpropane laurate and sodium pentadecyl sulfonate at room temperature and put into 11 # mineral oil. Then uniformly stir at 48° C. for 3 hours to obtain an oil agent. By weight, the components are added with the following amounts: 11 # mineral oil 8 parts; trimethylolpropane laurate 10 parts; 2-hydroxymethyl-15-crown-5 85 parts; dodecacanol phosphate potassium salt 11 parts, sodium pentadecyl sulfonate 5 parts. The content of crown ether in the prepared oil agent is 70.83 wt %, and the oil agent has excellent high temperature resistance. After heat treatment at 200° C. for 2 hours, the weight loss of oil agent is 11 wt %, and the viscosity of the oil agent is relatively low, at (50±0.01) ° C. the kinematic viscosity is 30.1 $mm^2/s$, the kinematic viscosity with 10 wt % concentration after being dissolved by water is 0.94 $mm^2/s$, the oil film strength of the oil is 125 N, and the surface tension of the oil is 23.2 cN/cm. The specific resistance is $1.8\times10^8\Omega\cdot cm$. After oiling, the coefficient of static friction ($\mu_s$) between fiber and fiber (F/F) is 0.250, and the coefficient of dynamic friction ($\mu_d$) is 0.272. After oiling, fiber and metal (F/M) The coefficient of static friction ($\mu_s$) is 0.209, the coefficient of dynamic friction ($\mu_d$) is 0.329, and the oil agent is prepared by adding water to obtain an emulsion having a concentration of 10% by weight;

(2) The lightweight heat-preserving fiber obtained by subjecting the polyester melt to measuring, extrusion by composite spinneret, cooling, oiling, drawing, heat setting and winding.

The composite spinneret plate has a hollow spinning hole and a circular spinning hole at the same time. The ratio of the micropore length of hollow spinning hole to circular spinning hole equals to the ratio of the equivalent diameter of hollow spinning hole to circular spinning hole multiplies the coefficient K, and the equivalent diameter is the ratio of the cross-sectional area to the circumference of the cross-section, the coefficient K is 1.00, the micro-hole length of the hollow spinning hole is 0.20 mm, and the micro-hole length of the circular spinning hole is 0.20 mm. The equivalent diameter is 0.16 mm, and all the spinning holes are arranged concentrically on the spinneret. The centers of all the spinning holes or the center of the circumscribed circle are on the concentric circles. The concentric circles are equidistant concentric circles on the same circle. The spinning holes on the same circle are arranged at equal intervals, and there are hollow spinning holes and circular spinning holes on the same circle. The quantity ratio of hollow spinning holes to the circular spinning holes is 6:1. The spinning process parameters of the lightweight heat-preserving fiber POY yarn are as follows: the spinning temperature is 285° C.; the cooling temperature is 25° C.; the winding speed is 2900 m/min; the spinning process parameters of the lightweight heat-preserving fiber DTY yarn are as follows: the spinning speed is 550 m/min; setting overfeed rate is 3.5%; winding overfeed rate is 2.5%; T1 is 250° C.; T2 is 122° C.; DR is 1.5; D/Y is 1.55; network pressure is 0.15 MPa.

The final obtained spinneret can extrude a bundle of lightweight heat-preserving fiber containing both hollow monofilament and round monofilament having a capillary parameter of 0.18. The knit fabric having a basis weight of 100 $g/m^2$ prepared from lightweight heat-preserving fibers has a thermal conductivity of 0.150 W/m·K, the hollow monofilament has a fineness of 1.6 dtex, and the circular monofilament has a fineness of 0.21 dtex. The lightweight thermal fiber has a fineness of 85 dtex, a breaking strength of 2.5 cN/dtex, an elongation at break of 18.0%, a crimp shrinkage of 8.9%, a linear density deviation of 1.8%, and a breaking strength CV of 6.6%, the elongation at break CV value of 7.5%, the variation coefficient CV of the crimp shrinkage rate of 8.1%, the boiling water shrinkage of 3.0%, and the capillary parameter of 0.19.

Example 4

A lightweight heat-preserving fiber, its preparation method comprises:

(1) the preparation of oil agent in oiling;

Uniformly mix 2-hydroxymethyl-12-crown-4 with dodecyl phosphate potassium salt, trimethylolpropane laurate and sodium hexadecane sulfonate at room temperature and put into 12 # mineral oil. Then uniformly stir at 40° C. for 2.5 hours to obtain an oil agent. By weight, the components are added with the following amounts: 12 # mineral oil 5 parts; 2-hydroxymethyl-12-crown-4 95 parts; dodecyl phosphate potassium salt 9 parts; sodium hexadecyl sulfonate 2 parts. The content of crown ether in the prepared oil agent is 85.58 wt %, and the oil agent has excellent high temperature resistance. After heat treatment at 200° C. for 2 hours, the weight loss of oil agent is 9 wt %, and the viscosity of the oil agent is relatively low, at (50±0.01) ° C. the kinematic viscosity is 29.5 $mm^2/s$, the kinematic viscosity with 10 wt % concentration after being dissolved by water is 0.93 $mm^2/s$, the oil film strength of the oil is 121 N, and the surface tension of the oil is 24.3 cN/cm. The specific resistance is $1.0\times10^8\Omega\cdot cm$. After oiling, the coefficient of static friction ($\mu_s$) between fiber and fiber (F/F) is 0.260, and the coefficient of dynamic friction ($\mu_d$) is 0.263. After oiling, fiber and metal (F/M) The coefficient of static friction ($\mu_s$) is 0.202, the coefficient of dynamic friction ($\mu_d$) is 0.330, and the oil agent is prepared by adding water to obtain an emulsion having a concentration of 19% by weight;

(2) The lightweight heat-preserving fiber obtained by subjecting the polyester melt to measuring, extrusion by composite spinneret, cooling, oiling, drawing, heat setting and winding.

The composite spinneret plate has a hollow spinning hole and a circular spinning hole at the same time. The ratio of the micropore length of hollow spinning hole to circular spinning hole equals to the ratio of the equivalent diameter of hollow spinning hole to circular spinning hole multiplies the coefficient K, and the equivalent diameter is the ratio of the cross-sectional area to the circumference of the cross-section, the coefficient K is 1.02, the micro-hole length of the hollow spinning hole is 0.97 mm, and the micro-hole length of the circular spinning hole is 0.97 mm. The equivalent diameter is 0.24 mm, and all the spinning holes are arranged concentrically on the spinneret. The centers of all the spinning holes or the center of the circumscribed circle are on the concentric circles. The concentric circles are equidistant concentric circles on the same circle. The spinning holes on the same circle are arranged at equal intervals, and there are hollow spinning holes and circular spinning holes on the same circle. The quantity ratio of hollow spinning holes to the circular spinning holes is 7:1. The spinning process parameters of the lightweight heat-preserving fiber POY yarn are as follows: the spinning temperature is 288° C.; the cooling temperature is 25° C.; the winding speed is 3200 m/min; the spinning process parameters of the lightweight heat-preserving fiber DTY yarn are as follows: the spinning speed is 650 m/min; setting overfeed rate is 5.5%; winding overfeed rate is 4.0%; T1 is 262° C.; T2 is 135° C.; DR is 1.43; D/Y is 1.5; network pressure is 0.20 MPa.

The final obtained spinneret can extrude a bundle of lightweight heat-preserving fiber containing both hollow monofilament and round monofilament having a capillary parameter of 0.10. The knit fabric having a basis weight of 100 $g/m^2$ prepared from lightweight heat-preserving fibers has a thermal conductivity of 0.144 W/m·K, the hollow monofilament has a fineness of 1.5 dtex, and the circular monofilament has a fineness of 0.24 dtex. The lightweight thermal fiber has a fineness of 85 dtex, a breaking strength of 2.8 cN/dtex, an elongation at break of 20.0%, a crimp shrinkage of 8.0%, a linear density deviation of 0.5%, and a breaking strength CV of 5.9%, the elongation at break CV value of 8.0%, the variation coefficient CV of the crimp shrinkage rate of 7.9%, and the boiling water shrinkage of 4.0%.

Example 5

A lightweight heat-preserving fiber, its preparation method comprises:

(1) the preparation of oil agent in oiling;

Uniformly mix 15-crown-5 and isomeric tridecyl ethoxylate phosphate potassium salt, trimethylolpropane laurate and sodium dodecyl sulfate at room temperature and put into 13 # mineral oil. Then uniformly stir at 52° C. for 2 hours to obtain an oil agent. By weight, the components are added with the following amounts: 13 # mineral oil 10 parts; trimethylolpropane laurate 5 parts; 15-crown-5 70 parts; isomeric tridecyl ethoxylate phosphate potassium salt 8 parts, sodium dodecyl sulfate 6 parts. The content of crown ether in the prepared oil agent is 70.70 wt %, and the oil agent has excellent high temperature resistance. After heat treatment at 200° C. for 2 hours, the weight loss of oil agent is 13.5 wt %, and the viscosity of the oil agent is relatively low, at (50±0.01) ° C. the kinematic viscosity is 28.6 $mm^2/s$, the kinematic viscosity with 10 wt % concentration after being dissolved by water is 0.95 $mm^2/s$, the oil film strength of the oil is 126 N, and the surface tension of the oil is 24.9 cN/cm. The specific resistance is $1.2\times10^8\Omega\cdot cm$. After oiling, the coefficient of static friction ($\mu_s$) between fiber and fiber (F/F) is 0.251, and the coefficient of dynamic friction ($\mu_d$) is 0.262. After oiling, fiber and metal (F/M) The coefficient of static friction ($\mu_s$) is 0.202, the coefficient of dynamic friction ($\mu_d$) is 0.332, and the oil agent is prepared by adding water to obtain an emulsion having a concentration of 11% by weight;

(2) The lightweight heat-preserving fiber obtained by subjecting the polyester melt to measuring, extrusion by composite spinneret, cooling, oiling, drawing, heat setting and winding.

The composite spinneret plate has a hollow spinning hole and a circular spinning hole at the same time. The ratio of the micropore length of hollow spinning hole to circular spinning hole equals to the ratio of the equivalent diameter of hollow spinning hole to circular spinning hole multiplies the coefficient K, and the equivalent diameter is the ratio of the cross-sectional area to the circumference of the cross-section, the coefficient K is 0.97, the micro-hole length of the hollow spinning hole is 1.05 mm, and the micro-hole length of the circular spinning hole is 1.05 mm. The equivalent diameter is 0.16 mm, and all the spinning holes are arranged concentrically on the spinneret. The centers of all the spinning holes or the center of the circumscribed circle are on the concentric circles. The concentric circles are equidistant concentric circles on the same circle. The spinning holes on the same circle are arranged at equal intervals, and there are hollow spinning holes and circular spinning holes on the same circle. The quantity ratio of hollow spinning holes to the circular spinning holes is 8:1. The spinning process parameters of the lightweight heat-preserving fiber POY yarn are as follows: the spinning temperature is 290°

C.; the cooling temperature is 20° C.; the winding speed is 3000 m/min; the spinning process parameters of the lightweight heat-preserving fiber DTY yarn are as follows: the spinning speed is 750 m/min; setting overfeed rate is 5.5%; winding overfeed rate is 5.0%; T1 is 260° C.; T2 is 131° C.; DR is 1.49; D/Y is 1.52; network pressure is 0.25 MPa.

The final obtained spinneret can extrude a bundle of lightweight heat-preserving fiber containing both hollow monofilament and round monofilament having a capillary parameter of 0.12. The knit fabric having a basis weight of 100 g/m$^2$ prepared from lightweight heat-preserving fibers has a thermal conductivity of 0.150 W/m·K, the hollow monofilament has a fineness of 1.8 dtex, and the circular monofilament has a fineness of 0.22 dtex. The lightweight thermal fiber has a fineness of 95 dtex, a breaking strength of 2.4 cN/dtex, an elongation at break of 22.0%, a crimp shrinkage of 8.4%, a linear density deviation of 1.6%, and a breaking strength CV of 7.0%, the elongation at break CV value of 7.6%, the variation coefficient CV of the crimp shrinkage rate of 8.0%, and the boiling water shrinkage of 3.5%.

Example 6

A lightweight heat-preserving fiber, its preparation method comprises:

(1) the preparation of oil agent in oiling;

Uniformly mix 2-hydroxymethyl-15-crown-5 and twelve-tetradecyl phosphate potassium salt, trimethylolpropane laurate and sodium pentadecyl sulfonate at room temperature and put into 14 # mineral oil. Then uniformly stir at 55° C. for 1 hours to obtain an oil agent. By weight, the components are added with the following amounts: 14 # mineral oil 3 parts; trimethylolpropane laurate 10 parts; 2-hydroxymethyl-15-crown-5 75 parts; twelve-tetradecyl phosphate potassium salt 14 parts, sodium pentadecyl sulfonate 7 parts. The content of crown ether in the prepared oil agent is 68.80 wt %, and the oil agent has excellent high temperature resistance. After heat treatment at 200° C. for 2 hours, the weight loss of oil agent is 12 wt %, and the viscosity of the oil agent is relatively low, at (50±0.01) ° C. the kinematic viscosity is 27.5 mm$^2$/s, the kinematic viscosity with 10 wt % concentration after being dissolved by water is 0.95 mm$^2$/s, the oil film strength of the oil is 126 N, and the surface tension of the oil is 25.4 cN/cm. The specific resistance is $1.6\times10^8\Omega\cdot$cm. After oiling, the coefficient of static friction ($\mu_s$) between fiber and fiber (F/F) is 0.255, and the coefficient of dynamic friction ($\mu_d$) is 0.267. After oiling, fiber and metal (F/M) The coefficient of static friction ($\mu_s$) is 0.203, the coefficient of dynamic friction ($\mu_d$) is 0.330, and the oil agent is prepared by adding water to obtain an emulsion having a concentration of 20% by weight;

(2) The lightweight heat-preserving fiber obtained by subjecting the polyester melt to measuring, extrusion by composite spinneret, cooling, oiling, drawing, heat setting and winding.

The composite spinneret plate has a hollow spinning hole and a circular spinning hole at the same time. The ratio of the micropore length of hollow spinning hole to circular spinning hole equals to the ratio of the equivalent diameter of hollow spinning hole to circular spinning hole multiplies the coefficient K, and the equivalent diameter is the ratio of the cross-sectional area to the circumference of the cross-section, the coefficient K is 0.99, the micro-hole length of the hollow spinning hole is 0.72 mm, and the micro-hole length of the circular spinning hole is 0.725 mm. The equivalent diameter is 0.32 mm, and all the spinning holes are arranged concentrically on the spinneret. The centers of all the spinning holes or the center of the circumscribed circle are on the concentric circles. The concentric circles are equidistant concentric circles on the same circle. The spinning holes on the same circle are arranged at equal intervals, and there are hollow spinning holes and circular spinning holes on the same circle. The quantity ratio of hollow spinning holes to the circular spinning holes is 8:1. The spinning process parameters of the lightweight heat-preserving fiber POY yarn are as follows: the spinning temperature is 280° C.; the cooling temperature is 22° C.; the winding speed is 3100 m/min; the spinning process parameters of the lightweight heat-preserving fiber DTY yarn are as follows: the spinning speed is 550 m/min; setting overfeed rate is 5.5%; winding overfeed rate is 4.5%; T1 is 265° C.; T2 is 120° C.; DR is 1.45; D/Y is 1.58; network pressure is 0.05 MPa.

The final obtained spinneret can extrude a bundle of lightweight heat-preserving fiber containing both hollow monofilament and round monofilament having a capillary parameter of 0.18. The knit fabric having a basis weight of 100 g/m$^2$ prepared from lightweight heat-preserving fibers has a thermal conductivity of 0.142 W/m·K, the hollow monofilament has a fineness of 2.5 dtex, and the circular monofilament has a fineness of 0.20 dtex. The lightweight thermal fiber has a fineness of 100 dtex, a breaking strength of 2.1 cN/dtex, an elongation at break of 22.0%, a crimp shrinkage of 9.0%, a linear density deviation of 2.0%, and a breaking strength CV of 6.5%, the elongation at break CV value of 7.1%, the variation coefficient CV of the crimp shrinkage rate of 8.2%, and the boiling water shrinkage of 4.0%.

Example 7

A lightweight heat-preserving fiber, its preparation method comprises:

(1) the preparation of oil agent in oiling;

Uniformly mix 15-crown-5 and dodecyl phosphate potassium salt, trimethylolpropane laurate and sodium hexadecyl sulfonate at room temperature and put into 15 # mineral oil. Then uniformly stir at 41° C. for 2 hours to obtain an oil agent. By weight, the components are added with the following amounts: 15 # mineral oil 8 parts; trimethylolpropane laurate 20 parts; 15-crown-5 100 parts; dodecyl phosphate potassium salt 15 parts, sodium hexadecyl sulfonate 2 parts. The content of crown ether in the prepared oil agent is 68.97 wt %, and the oil agent has excellent high temperature resistance. After heat treatment at 200° C. for 2 hours, the weight loss of oil agent is 8.5 wt %, and the viscosity of the oil agent is relatively low, at (50±0.01) ° C. the kinematic viscosity is 28.4 mm$^2$/s, the kinematic viscosity with 10 wt % concentration after being dissolved by water is 0.94 mm$^2$/s, the oil film strength of the oil is 122 N, and the surface tension of the oil is 26.8 cN/cm. The specific resistance is $1.8\times10^8\Omega\cdot$cm. After oiling, the coefficient of static friction ($\mu_s$) between fiber and fiber (F/F) is 0.263, and the coefficient of dynamic friction ($\mu_d$) is 0.268. After oiling, fiber and metal (F/M) The coefficient of static friction ($\mu_s$) is 0.210, the coefficient of dynamic friction ($\mu_d$) is 0.320, and the oil agent is prepared by adding water to obtain an emulsion having a concentration of 13% by weight;

(2) The lightweight heat-preserving fiber obtained by subjecting the polyester melt to measuring, extrusion by composite spinneret, cooling, oiling, drawing, heat setting and winding.

The composite spinneret plate has a hollow spinning hole and a circular spinning hole at the same time. The ratio of the micropore length of hollow spinning hole to circular spinning hole equals to the ratio of the equivalent diameter of hollow spinning hole to circular spinning hole multiplies the coefficient K, and the equivalent diameter is the ratio of the cross-sectional area to the circumference of the cross-section, the coefficient K is 0.98, the micro-hole length of the hollow spinning hole is 1.28 mm, and the micro-hole length of the circular spinning hole is 1.287 mm. The equivalent diameter is 0.17 mm, and all the spinning holes are arranged concentrically on the spinneret. The centers of all the spinning holes or the center of the circumscribed circle are on the concentric circles. The concentric circles are equidistant concentric circles on the same circle. The spinning holes on the same circle are arranged at equal intervals. The spinning holes on the neighbouring circles are different. The spinning process parameters of the lightweight heat-preserving fiber POY yarn are as follows: the spinning temperature is 283° C.; the cooling temperature is 23° C.; the winding speed is 2900 m/min; the spinning process parameters of the lightweight heat-preserving fiber DTY yarn are as follows: the spinning speed is 550 m/min; setting overfeed rate is 5.0%; winding overfeed rate is 2.5%; T1 is 255° C.; T2 is 135° C.; DR is 1.5; D/Y is 1.56; network pressure is 0.05 MPa.

The final obtained spinneret can extrude a bundle of lightweight heat-preserving fiber containing both hollow monofilament and round monofilament having a capillary parameter of 0.20. The knit fabric having a basis weight of 100 g/m$^2$ prepared from lightweight heat-preserving fibers has a thermal conductivity of 0.140 W/m·K, the hollow monofilament has a fineness of 2.3 dtex, and the circular monofilament has a fineness of 0.25 dtex. The lightweight thermal fiber has a fineness of 95 dtex, a breaking strength of 3.6 cN/dtex, an elongation at break of 18.0%, a crimp shrinkage of 8.2%, a linear density deviation of 1.4%, and a breaking strength CV of 6.0%, the elongation at break CV value of 7.2%, the variation coefficient CV of the crimp shrinkage rate of 7.4%, and the boiling water shrinkage of 3.5%.

Example 8

A lightweight heat-preserving fiber, its preparation method comprises:

(1) the preparation of oil agent in oiling;

Uniformly mix 2-hydroxymethyl-12-crown-4 and twelve-tetradecyl phosphate potassium salt, trimethylolpropane laurate and sodium pentadecyl sulfonate at room temperature and put into 16 # mineral oil. Then uniformly stir at 45° C. for 3 hours to obtain an oil agent. By weight, the components are added with the following amounts: 16 # mineral oil 9 parts; 2-hydroxymethyl-12-crown-4 80 parts; twelve-tetradecyl phosphate potassium salt 12 parts; sodium pentadecyl sulfonate 5 parts. The content of crown ether in the prepared oil agent is 83.33 wt %, and the oil agent has excellent high temperature resistance. After heat treatment at 200° C. for 2 hours, the weight loss of oil agent is 14 wt %, and the viscosity of the oil agent is relatively low, at (50±0.01) ° C. the kinematic viscosity is 30.0 mm$^2$/s, the kinematic viscosity with 10 wt % concentration after being dissolved by water is 0.93 mm$^2$/s, the oil film strength of the oil is 127 N, and the surface tension of the oil is 23.5 cN/cm. The specific resistance is $1.5\times10^8\Omega\cdot$cm. After oiling, the coefficient of static friction ($\mu_s$) between fiber and fiber (F/F) is 0.262, and the coefficient of dynamic friction ($\mu_d$) is 0.273. After oiling, fiber and metal (F/M) The coefficient of static friction ($\mu_s$) is 0.208, the coefficient of dynamic friction ($\mu_d$) is 0.328, and the oil agent is prepared by adding water to obtain an emulsion having a concentration of 18% by weight;

(2) The lightweight heat-preserving fiber obtained by subjecting the polyester melt to measuring, extrusion by composite spinneret, cooling, oiling, drawing, heat setting and winding.

The composite spinneret plate has a hollow spinning hole and a circular spinning hole at the same time. The ratio of the micropore length of hollow spinning hole to circular spinning hole equals to the ratio of the equivalent diameter of hollow spinning hole to circular spinning hole multiplies the coefficient K, and the equivalent diameter is the ratio of the cross-sectional area to the circumference of the cross-section, the coefficient K is 1.03, the micro-hole length of the hollow spinning hole is 0.54 mm, and the micro-hole length of the circular spinning hole is 0.54 mm. The equivalent diameter is 0.16 mm, and all the spinning holes are arranged concentrically on the spinneret. The centers of all the spinning holes or the center of the circumscribed circle are on the concentric circles. The concentric circles are equidistant concentric circles on the same circle. The spinning holes on the same circle are arranged at equal intervals. The spinning holes on the neighbouring circles are different. The spinning process parameters of the lightweight heat-preserving fiber POY yarn are as follows: the spinning temperature is 280° C.; the cooling temperature is 23° C.; the winding speed is 3200 m/min; the spinning process parameters of the lightweight heat-preserving fiber DTY yarn are as follows: the spinning speed is 550 m/min; setting overfeed rate is 4.5%; winding overfeed rate is 3.5%; T1 is 250° C.; T2 is 125° C.; DR is 1.5; D/Y is 1.6; network pressure is 0.1 MPa.

The final obtained spinneret can extrude a bundle of lightweight heat-preserving fiber containing both hollow monofilament and round monofilament having a capillary parameter of 0.16. The knit fabric having a basis weight of 100 g/m$^2$ prepared from lightweight heat-preserving fibers has a thermal conductivity of 0.150 W/m·K, the hollow monofilament has a fineness of 2.2 dtex, and the circular monofilament has a fineness of 0.25 dtex. The lightweight thermal fiber has a fineness of 79 dtex, a breaking strength of 2.8 cN/dtex, an elongation at break of 20.0%, a crimp shrinkage of 8.7%, a linear density deviation of 2.0%, and a breaking strength CV of 6.4%, the elongation at break CV value of 8.0%, the variation coefficient CV of the crimp shrinkage rate of 7.0%, and the boiling water shrinkage of 3.0%.

Example 9

A lightweight heat-preserving fiber, its preparation method comprises:

(1) the preparation of oil agent in oiling;

Uniformly mix 2-hydroxymethyl-15-crown-5 and dodecyl phosphate potassium salt, trimethylolpropane laurate and sodium dodecyl sulfate at room temperature. Then uniformly stir at 55° C. for 3 hours to obtain an oil agent. By weight, the components are added with the following amounts: trimethylolpropane laurate 15 parts; 2-hydroxymethyl-15-crown-5 90 parts; dodecyl phosphate potassium salt 8 parts; sodium dodecyl sulfate 7 parts. The content of crown ether in the prepared oil agent is 81.81 wt %, and the oil agent has excellent high temperature resistance. After heat treatment at 200° C. for 2 hours, the weight loss of oil agent is 10 wt %, and the viscosity of the oil agent is relatively low, at (50±0.01) ° C. the kinematic viscosity is 29.7 mm$^2$/s, the kinematic viscosity with 10 wt % concentration after being dissolved by water is 0.94 mm$^2$/s, the oil film strength of the oil is 126 N, and the surface tension of the oil is 24.8 cN/cm. The specific resistance is $1.8\times10^8\Omega\cdot$cm. After oiling, the coefficient of static friction ($\mu_s$) between fiber and fiber (F/F) is 0.250, and the coefficient of dynamic friction ($\mu_d$) is 0.264. After oiling, fiber and metal (F/M) The coefficient of static friction ($\mu_s$) is 0.210, the coefficient of dynamic friction ($\mu_d$) is 0.321, and the oil agent is prepared by adding water to obtain an emulsion having a concentration of 10% by weight;

(2) The lightweight heat-preserving fiber obtained by subjecting the polyester melt to measuring, extrusion by composite spinneret, cooling, oiling, drawing, heat setting and winding.

The composite spinneret plate has a hollow spinning hole and a circular spinning hole at the same time. The ratio of the micropore length of hollow spinning hole to circular spinning hole equals to the ratio of the equivalent diameter of hollow spinning hole to circular spinning hole multiplies the coefficient K, and the equivalent diameter is the ratio of the cross-sectional area to the circumference of the cross-section, the coefficient K is 0.97, the micro-hole length of the hollow spinning hole is 0.49 mm, and the micro-hole length of the circular spinning hole is 0.49 mm. The equivalent diameter is 0.12 mm, and all the spinning holes are arranged concentrically on the spinneret. The centers of all the spinning holes or the center of the circumscribed circle are on the concentric circles. The concentric circles are equidistant concentric circles on the same circle. The spinning holes on the same circle are arranged at equal intervals, and there are hollow spinning holes and circular spinning holes on the same circle. The quantity ratio of hollow spinning holes to the circular spinning holes is 5:1. The spinning process parameters of the lightweight heat-preserving fiber POY yarn are as follows: the spinning temperature is 287° C.; the cooling temperature is 24° C.; the winding speed is 2800 m/min; the spinning process parameters of the lightweight heat-preserving fiber DTY yarn are as follows: the spinning speed is 550 m/min; setting overfeed rate is 4.0%; winding overfeed rate is 3.5%; T1 is 263° C.; T2 is 120° C.; DR is 1.42; D/Y is 1.54; network pressure is 0.05 MPa.

The final obtained spinneret can extrude a bundle of lightweight heat-preserving fiber containing both hollow monofilament and round monofilament having a capillary parameter of 0.19. The knit fabric having a basis weight of 100 g/m$^2$ prepared from lightweight heat-preserving fibers has a thermal conductivity of 0.149 W/m·K, the hollow monofilament has a fineness of 1.5 dtex, and the circular monofilament has a fineness of 0.24 dtex. The lightweight thermal fiber has a fineness of 80 dtex, a breaking strength of 2.5 cN/dtex, an elongation at break of 18.0%, a crimp shrinkage of 8.2%, a linear density deviation of 0.9%, and a breaking strength CV of 6.7%, the elongation at break CV value of 7.4%, the variation coefficient CV of the crimp shrinkage rate of 8.5%, and the boiling water shrinkage of 3.0%.

Example 10

A lightweight heat-preserving fiber, its preparation method comprises:

(1) the preparation of oil agent in oiling;

Uniformly mix 2-hydroxymethyl-15-crown-5 and dodecyl phosphate potassium salt, trimethylolpropane laurate and sodium dodecyl sulfate at room temperature. Then uniformly stir at 55° C. for 3 hours to obtain an oil agent. By weight, the components are added with the following amounts: trimethylolpropane laurate 15 parts; 2-hydroxymethyl-15-crown-5 90 parts; dodecyl phosphate potassium salt 8 parts; sodium dodecyl sulfate 7 parts. The content of crown ether in the prepared oil agent is 81.81 wt %, and the oil agent has excellent high temperature resistance. After heat treatment at 200° C. for 2 hours, the weight loss of oil agent is 10 wt %, and the viscosity of the oil agent is relatively low, at (50±0.01) ° C. the kinematic viscosity is 29.7 mm$^2$/s, the kinematic viscosity with 10 wt % concentration after being dissolved by water is 0.94 mm$^2$/s, the oil film strength of the oil is 126 N, and the surface tension of the oil is 24.8 cN/cm. The specific resistance is $1.8\times10^8\Omega\cdot$cm. After oiling, the coefficient of static friction ($\mu_s$) between fiber and fiber (F/F) is 0.250, and the coefficient of dynamic friction ($\mu_d$) is 0.264. After oiling, fiber and metal (F/M) The coefficient of static friction ($\mu_s$) is 0.210, the coefficient of dynamic friction ($\mu_d$) is 0.321, and the oil agent is prepared by adding water to obtain an emulsion having a concentration of 10% by weight;

(2) The lightweight heat-preserving fiber obtained by subjecting the polyester melt to measuring, extrusion by composite spinneret, cooling, oiling, drawing, heat setting and winding.

The composite spinneret plate has a hollow spinning hole and a circular spinning hole at the same time. The ratio of the micropore length of hollow spinning hole to circular spinning hole equals to the ratio of the equivalent diameter of hollow spinning hole to circular spinning hole multiplies the coefficient K, and the equivalent diameter is the ratio of the cross-sectional area to the circumference of the cross-section, the coefficient K is 0.98, the micro-hole length of the hollow spinning hole is 0.24 mm, and the micro-hole length of the circular spinning hole is 0.24 mm. The equivalent diameter is 0.25 mm, and all the spinning holes are arranged concentrically on the spinneret. The centers of all the spinning holes or the center of the circumscribed circle are on the concentric circles. The concentric circles are equidistant concentric circles on the same circle. The spinning holes on the same circle are arranged at equal intervals, and there are hollow spinning holes and circular spinning holes on the same circle. The quantity ratio of hollow spinning holes to the circular spinning holes is 7:1. The spinning process parameters of the lightweight heat-preserving fiber POY yarn are as follows: the spinning temperature is 283° C.; the cooling temperature is 25° C.; the winding speed is 2900 m/min; the spinning process parameters of the lightweight heat-preserving fiber DTY yarn are as follows: the spinning speed is 750 m/min; setting overfeed rate is 3.5%; winding overfeed rate is 4.0%; T1 is 259° C.; T2 is 130° C.; DR is 1.4; D/Y is 1.51; network pressure is 0.3 MPa.

The final obtained spinneret can extrude a bundle of lightweight heat-preserving fiber containing both hollow monofilament and round monofilament having a capillary parameter of 0.12. The knit fabric having a basis weight of 100 g/m$^2$ prepared from lightweight heat-preserving fibers has a thermal conductivity of 0.143 W/m·K, the hollow monofilament has a fineness of 1.9 dtex, and the circular monofilament has a fineness of 0.23 dtex. The lightweight thermal fiber has a fineness of 85 dtex, a breaking strength of 2.1 cN/dtex, an elongation at break of 22.0%, a crimp shrinkage of 9.0%, a linear density deviation of 1.7%, and a breaking strength CV of 6.8%, the elongation at break CV value of 7.9%, the variation coefficient CV of the crimp shrinkage rate of 8.3%, and the boiling water shrinkage of 3.5%.

Example 11

A lightweight heat-preserving fiber, its preparation method comprises:

(1) the preparation of oil agent in oiling;

Uniformly mix 2-hydroxymethyl-12-crown-4 with dodecyl phosphate potassium salt, trimethylolpropane laurate and sodium dodecyl sulfate at room temperature and put into 9 # mineral oil. Then uniformly stir at 40° C. for 1 hours to obtain an oil agent. By weight, the components are added with the following amounts: 9 # mineral oil 2 parts; 2-hydroxymethyl-12-crown-4 90 parts; dodecyl phosphate potassium salt 8 parts; sodium dodecyl sulfate 3 parts, trimethylolpropane laurate 10 parts. The content of crown ether in the prepared oil agent is 79.6 wt %, and the oil agent has excellent high temperature resistance. After heat treatment at 200° C. for 2 hours, the weight loss of oil agent is 14.5 wt %, and the viscosity of the oil agent is relatively low, at (50±0.01) ° C. the kinematic viscosity is 29.6 $mm^2/s$, the kinematic viscosity with 10 wt % concentration after being dissolved by water is 0.93 $mm^2/s$, the oil film strength of the oil is 125 N, and the surface tension of the oil is 24.8 cN/cm. The specific resistance is $1.3\times10^8\Omega$~cm. After oiling, the coefficient of static friction ($\mu_s$) between fiber and fiber (F/F) is 0.255, and the coefficient of dynamic friction ($\mu_d$) is 0.266. After oiling, fiber and metal (F/M) The coefficient of static friction ($\mu_s$) is 0.203, the coefficient of dynamic friction ($\mu_d$) is 0.320, and the oil agent is prepared by adding water to obtain an emulsion having a concentration of 15% by weight;

(2) The lightweight heat-preserving fiber obtained by subjecting the polyester melt to measuring, extrusion by composite spinneret, cooling, oiling, drawing, heat setting and winding.

The composite spinneret plate has a hollow spinning hole and a circular spinning hole at the same time. The ratio of the micropore length of hollow spinning hole to circular spinning hole equals to the ratio of the equivalent diameter of hollow spinning hole to circular spinning hole multiplies the coefficient K, and the equivalent diameter is the ratio of the cross-sectional area to the circumference of the cross-section, the coefficient K is 1.03, the micro-hole length of the hollow spinning hole is 0.60 mm, and the micro-hole length of the circular spinning hole is 0.598 mm. The equivalent diameter is 0.27 mm, and all the spinning holes are arranged concentrically on the spinneret. The centers of all the spinning holes or the center of the circumscribed circle are on the concentric circles. The concentric circles are equidistant concentric circles on the same circle. The spinning holes on the same circle are arranged at equal intervals, and there are hollow spinning holes and circular spinning holes on the same circle. The quantity ratio of hollow spinning holes to the circular spinning holes is 7:1. The spinning process parameters of the lightweight heat-preserving fiber POY yarn are as follows: the spinning temperature is 290° C.; the cooling temperature is 20° C.; the winding speed is 3100 m/min; the spinning process parameters of the lightweight heat-preserving fiber DTY yarn are as follows: the spinning speed is 700 m/min; setting overfeed rate is 4.5%; winding overfeed rate is 5.0%; T1 is 261° C.; T2 is 134° C.; DR is 1.5; D/Y is 1.5; network pressure is 0.20 MPa.

The final obtained spinneret can extrude a bundle of lightweight heat-preserving fiber containing both hollow monofilament and round monofilament having a capillary parameter of 0.13. The knit fabric having a basis weight of 100 $g/m^2$ prepared from lightweight heat-preserving fibers has a thermal conductivity of 0.144 W/m·K, the hollow monofilament has a fineness of 2.5 dtex, and the circular monofilament has a fineness of 0.20 dtex. The lightweight thermal fiber has a fineness of 100 dtex, a breaking strength of 2.3 cN/dtex, an elongation at break of 18.0%, a crimp shrinkage of 8.5%, a linear density deviation of 1.4%, and a breaking strength CV of 6.6%, the elongation at break CV value of 7.5%, the variation coefficient CV of the crimp shrinkage rate of 7.6%, and the boiling water shrinkage of 4.0%.

What is claimed is:

1. A method for preparing a lightweight heat-preserving fiber, comprising: performing measuring, composite spinneret extrusion, cooling, oiling, drawing, heat setting, and winding on a polyester melt to obtain the lightweight heat-preserving fiber;

wherein a composite spinneret plate has a plurality of hollow spinning holes and a plurality of circular spinning holes at the same time; a ratio of a micropore length of each hollow spinning hole of the plurality of hollow spinning holes to a micropore length of each hollow spinning hole of the plurality of circular spinning holes equals to a product of a ratio of an equivalent diameter of the each hollow spinning hole to an equivalent diameter of the each circular spinning hole and a coefficient K, the equivalent diameter of the each hollow spinning hole is a ratio of a cross-sectional area to a cross-sectional circumference of the each hollow spinning hole, the equivalent diameter of the each circular spinning hole is a ratio of a cross-sectional area to a cross-sectional circumference of the each circular spinning hole, and the coefficient K ranges from 0.97-1.03;

wherein oiling involves using an oil agent contains a crown ether, and a content of the crown ether ranges from 67.30 wt %-85.58 wt %;

wherein a bundle of the lightweight heat-preserving fiber extruded from the composite spinneret plate comprise a hollow monofilament and a circular monofilament, and the lightweight heat-preserving fiber is made of polyester; and wherein a thermal conductivity of a knitted fabric having a basis weight of 100 $g/m^2$ is less than or equal to 0.150 W/m·K, and the knitted fabric is prepared by the lightweight heat-preserving fiber.

2. The method of claim 1, wherein the micropore length of each hollow spinning hole and the micropore length of the each circular spinning hole range from 0.20 mm-1.28 mm; the equivalent diameter of the each hollow spinning hole and the equivalent diameter of the each circular spinning hole range from 0.10 mm-0.32 mm; and wherein the plurality of hollow spinning holes and the plurality of circular spinning holes are arranged concentrically on the composite spinneret plate; centers of the plurality of hollow spinning holes and centers of the plurality of circular spinning holes are on a first plurality of concentric circles; or centers of circumscribed circles of the plurality of hollow spinning holes and the plurality of circular spinning holes are on a second plurality of concentric circles; the first plurality of concentric circles and the second plurality of concentric circles are equidistant concentric circles; a first plurality of spinning holes of the plurality of hollow spinning holes and the plurality of circular spinning holes are arranged at a same interval, and the first plurality of spinning holes are on a same circle.

3. The method of claim 2, wherein the first plurality of spinning holes are hollow spinning holes or circular spinning holes, shapes of a second plurality of spinning holes of the plurality of hollow spinning holes and the plurality of circular spinning holes are different, and the second plurality of spinning holes are on adjacent two circles;

or the first plurality of spinning holes comprise hollow spinning holes and circular spinning holes, a quantity ratio of the hollow spinning holes to the circular spinning holes in the first plurality of spinning holes ranges from 5-8:1.

4. The method of claim 1, wherein the oil agent has a thermal weight loss of less than 15% by weight after a heat treatment at 200° C. for 2 hours;

wherein the oil agent has a kinematic viscosity of 27.5 $mm^2/s$-30.1 $mm^2/s$ at (50±0.01) ° C., and the kinematic viscosity of the oil agent after being disposed in a concentration of 10 wt % is 0.93 $mm^2/s$-0.95 $mm^2/s$;

wherein an oil film strength of the oil agent is 121 N-127 N;

wherein a surface tension of the oil agent is 23.2 cN/cm-26.8 cN/cm, and a specific resistance of the oil agent is $1.0\times10^8$-$1.8\times10^8\Omega\cdot$cm;

wherein after the oiling, a static friction coefficient between the lightweight heat-preserving fibers is 0.250-0.263, and a dynamic friction coefficient between the lightweight heat-preserving fibers is 0.262-0.273; and wherein after the oiling, a static friction coefficient between the lightweight heat-preserving fiber and a metal is 0.202-0.210, and a dynamic friction coefficient between the lightweight heat-preserving fiber and the metal is 0.320-0.332.

5. The method of claim 4, wherein the crown ether is 2-hydroxymethyl-12-crown-4, 15-crown-5, or 2-hydroxymethyl-15-crown-5;

the oil agent further comprises a mineral oil, a potassium phosphate salt, a trimethylolpropane laurate and a sodium alkyl sulfonate;

the mineral oil is one selected from the group consisting of mineral oils of 9 #-17 #;

the potassium phosphate salt is a potassium salt of lauryl phosphate, an isomeric tridecyl polyoxyethylene ether phosphate potassium salt or a tetradecyl alcohol phosphate potassium salt;

the sodium alkyl sulfonate is sodium dodecyl sulfate, sodium pentadecyl sulfonate or sodium hexadecane sulfonate;

the oil agent in use is disposed in water to obtain an emulsion having a concentration of 10%-20% by weight; and a method for preparing the oil agent comprises:

uniformly mixing the crown ether, the potassium phosphate salt, the trimethylolpropane laurate and the sodium alkyl sulfonate to obtain a first mixture;

adding the first mixture to the mineral oil and stirring to obtain the oil agent;

an amount of each of the mineral oil, the phosphate potassium salt, the trimethylolpropane laurate, the crown ether, and the sodium alkyl sulfonate by weight is as follows:

mineral oil 0 part-10 parts;

trimethylolpropane laurate 0 part-20 parts;

crown ether 70 parts-100 parts;

phosphate potassium salt 8 parts-15 parts;

sodium alkyl sulfonate 2 parts-7 parts;

the mixing is carried out at a normal temperature, and a temperature of the stirring is 40° C.-55° C., and a time of the stirring is 1 hour-3 hours.

6. The method of claim 1, wherein a plurality of spinning process parameters of a lightweight heat-preserving fiber POY yarn are as follows:

spinning temperature: 280° C.-290° C.;

cooling temperature: 20° C.-25° C.;

winding speed: 2800 m/min-3200 m/min;

a plurality of spinning process parameters of a lightweight heat-preserving fiber DTY yarn are as follows:

spinning speed: 550 m/min-750 m/min;

styling overfeed rate: 3.5%-5.5%;

winding overfeed rate: 2.5%-5.0%;

T1: 250° C.-265° C.;

T2: 120° C.-135° C.;

DR: 1.4-1.5;

D/Y: 1.5-1.6; and network pressure: 0.05 MPa-0.3 MPa.

7. The method of claim 1, wherein a fineness of the hollow monofilament is 1.5 dtex-2.5 dtex, and a fineness of the circular monofilament is 0.20 dtex-0.30 dtex.

8. The method of claim 1, wherein a fineness of the lightweight heat-preserving fiber is 75 dtex-100 dtex, a breaking strength of the lightweight heat-preserving fiber is larger than or equal to 2.1 cN/dtex, and an elongation at break of the lightweight heat-preserving fiber is 20.0±2.0%, a crimp shrinkage of the lightweight heat-preserving fiber is less than or equal to 9.0%, a linear density deviation of the lightweight heat-preserving fiber is less than or equal to 2.0%, a breaking strength coefficient of variation (CV) value of the lightweight heat-preserving fiber is less than or equal to 7.0%, an elongation at break CV value of the lightweight heat-preserving fiber is less than or equal to 8.0%, a crimp shrinkage CV value of the lightweight heat-preserving fiber is less than or equal to 8.5%, and a boiling water shrinkage of the lightweight heat-preserving fiber is 3.5±0.5%.

9. The method of claim 8, wherein the lightweight heat-preserving fiber has a capillary parameter of greater than or equal to 0.10.

10. The method of claim 2, wherein a plurality of spinning process parameters of a lightweight heat-preserving fiber POY yarn are as follows:

spinning temperature: 280° C.-290° C.;

cooling temperature: 20° C.-25° C.;

winding speed: 2800 m/min-3200 m/min;

a plurality of spinning process parameters of a lightweight heat-preserving fiber DTY yarn are as follows:

spinning speed: 550 m/min-750 m/min;

styling overfeed rate: 3.5%-5.5%;

winding overfeed rate: 2.5%-5.0%;

T1: 250° C.-265° C.;

T2: 120° C.-135° C.;

DR: 1.4-1.5;

D/Y: 1.5-1.6;

network pressure: 0.05 MPa-0.3 MPa.

11. The method of claim 3, wherein a plurality of spinning process parameters of a lightweight heat-preserving fiber POY yarn are as follows:

spinning temperature: 280° C.-290° C.;

cooling temperature: 20° C.-25° C.;

winding speed: 2800 m/min-3200 m/min;

a plurality of spinning process parameters of a lightweight heat-preserving fiber DTY yarn are as follows:

spinning speed: 550 m/min-750 m/min;

styling overfeed rate: 3.5%-5.5%;

winding overfeed rate: 2.5%-5.0%;

T1: 250° C.-265° C.;

T2: 120° C.-135° C.;

DR: 1.4-1.5;

D/Y: 1.5-1.6;

network pressure: 0.05 MPa-0.3 MPa.

12. The method of claim 4, wherein a plurality of spinning process parameters of a lightweight heat-preserving fiber POY yarn are as follows:

spinning temperature: 280° C.-290° C.;
cooling temperature: 20° C.-25° C.;
winding speed: 2800 m/min-3200 m/min;
a plurality of spinning process parameters of a lightweight heat-preserving fiber DTY yarn are as follows:
spinning speed: 550 m/min-750 m/min;
styling overfeed rate: 3.5%-5.5%;
winding overfeed rate: 2.5%-5.0%;
T1: 250° C.-265° C.;
T2: 120° C.-135° C.;
DR: 1.4-1.5;
D/Y: 1.5-1.6;
network pressure: 0.05 MPa-0.3 MPa.

13. The method of claim 5, wherein a plurality of spinning process parameters of a lightweight heat-preserving fiber POY yarn are as follows:
spinning temperature: 280° C.-290° C.;
cooling temperature: 20° C.-25° C.;
winding speed: 2800 m/min-3200 m/min;
a plurality of spinning process parameters of a lightweight heat-preserving fiber DTY yarn are as follows:
spinning speed: 550 m/min-750 m/min;
styling overfeed rate: 3.5%-5.5%;
winding overfeed rate: 2.5%-5.0%;
T1: 250° C.-265° C.;
T2: 120° C.-135° C.;
DR: 1.4-1.5;
D/Y: 1.5-1.6;
network pressure: 0.05 MPa-0.3 MPa.

* * * * *